US005997959A

United States Patent [19]

Lebioda

[11] Patent Number: 5,997,959

[45] Date of Patent: Dec. 7, 1999

[54] METHOD AND APPARATUS FOR ELECTROSTATICALLY PAINTING PARTS MADE OF DIELECTRIC OR LOW-CONDUCTIVITY MATERIAL

[75] Inventor: Robert Lebioda, Torreilles, France

[73] Assignee: Societe LCS International, Villeneuve De La Riviere, France

[21] Appl. No.: 08/817,816

[22] PCT Filed: Oct. 4, 1995

[86] PCT No.: PCT/FR95/01284

§ 371 Date: May 2, 1997

§ 102(e) Date: May 2, 1997

[87] PCT Pub. No.: WO96/11063

PCT Pub. Date: Apr. 18, 1996

[30] Foreign Application Priority Data

Oct. 6, 1994 [FR] France ..... 94 12130

[51] Int. Cl.[6] ..... B05D 1/06; B05D 7/06; B05B 5/025; B05B 5/02

[52] U.S. Cl. ..... 427/475; 427/476; 427/485; 427/486; 118/624; 118/629; 118/634

[58] Field of Search ..... 427/475, 476, 427/485, 486; 118/624, 629, 634

[56] References Cited

U.S. PATENT DOCUMENTS 2,662,833 12/1953 Helmuth .
3,903,321 9/1975 Schaad .

FOREIGN PATENT DOCUMENTS 572 358 1/1993 European Pat. Off. .
636 669 1/1995 European Pat. Off. .
57-194074 11/1982 Japan .

*Primary Examiner*—Fred J. Parker
*Attorney, Agent, or Firm*—Harrison & Egbert

[57] ABSTRACT

A method for painting a parts made of dielectric or low-conductivity material using a paint spraying unit including a chamber connected to both a paint outlet and to a paint supply. At least one electrode is mechanically and electrically connected to the part. An electrostatic field is generated between the electrode and the paint spraying unit. Paint is fed from the paint supply through the chamber to the outlet. The paint is electrically charged. The paint is sprayed onto the part to be painted. The outer surface of the electrode used includes at least one jagged portion for engaging the part to be painted. The jagged portion is the location of a peak electrostatic effect.

11 Claims, 4 Drawing Sheets

METHOD AND APPARATUS FOR ELECTROSTATICALLY PAINTING PARTS MADE OF DIELECTRIC OR LOW-CONDUCTIVITY MATERIAL

TECHNICAL FIELD

The instant invention teaches a method for painting parts made of dielectric or low-conductivity material, an electrode for painting parts made of dielectric or low-conductivity material and an apparatus for painting parts made of dielectric or low-conductivity material The instant invention applies particularly to the carpentry and furniture industries.

BACKGROUND ART

The current methods for painting on wood involve sanding, staining, waiting for the stain to dry, peeling off the stain, applying a liquid finish, waiting for the liquid finish to dry and then repeating this process several times, often as many as seven times. The edges of the boards are treated separately and the two faces must be treated several times. The entire process, therefore, takes two and a half days (for a basic finish) or up to four days (for complex forms involving moldings, cuttings and grooves). Additionally, the liquid finishes are not guaranteed to hold more than one, or maybe a few years. The spectrum of colors is forcibly very limited. Finally, the coats of finish must be applied evenly; in other words, the number of coats on the two faces generally must be the same, or the board will appear shaded.

Other methods for finishing wood involve coating the faces of the board with a sheet of laminated paper or veneering. Complex forms are, therefore, difficult to finish, if not impossible, by such a means of manufacture. The coatings and their bondings with the wood are of limited value against impacts to the wood.

Finally, a last method involves applying, by way of pressure and heat, a film of plastic material of different color and structure on one face and the four edges. This method cannot be used to cover the entirety of a board in one application. Further, the natural grain of the face of the wood may allow the film to show through The choice of colors here, too, is very limited.

The instant invention seeks to resolve these problems by proposing a method of painting parts made of dielectric or low-conductivity material in particular wood, an electrode and an apparatus for painting on said materials using said method.

SUMMARY OF THE INVENTION

The method described in the instant invention is a method for painting parts made of dielectric or low-conductivity material in which a paint-spraying unit including a chamber connected to both a paint outlet and a paint supply is used. This method essentially involves mechanically and electrically connecting at least one electrode to the part to be painted, creating an electrostatic field between the electrode and the paint spraying unit by applying a difference of electrical potential between the electrode and another electrode lodged in the chamber of the paint spraying unit, feeding the paint from the paint supply through the chamber to the outlet, electrically charging the paint and spraying said paint onto the part to be painted.

A solid paint in powdered form is the preferred paint to be used. For example, a polyester-based, powdered paint could be used.

According to another embodiment, the method of painting involves inserting the electrode into the part to be painted. This embodiment allows for painting all external surfaces of the part to be painted.

In variation, the method of painting involves placing an electrode on at least one of the external faces of the part to be painted. Such a method limits painting to those faces not covered by the electrode(s).

The electrode according to the invention for electrostatically painting parts made of dielectric or low-conductivity material, intended to come into contact with the part to be painted and to be connected to one of the two poles of a source of electrical power contained in the apparatus, is essentially characterized by its exterior surface which contains at least one jagged portion for engaging the part to be painted, said jagged portion being the location of the so-called peak electrostatic effect.

The description which follows, referring to the attached drawings for explanatory, but not limiting, purposes allows for a better understanding of the advantages, goals and characteristics of the invention.

DETAILED DESCRIPTION OF THE INVENTION

Figure 1:
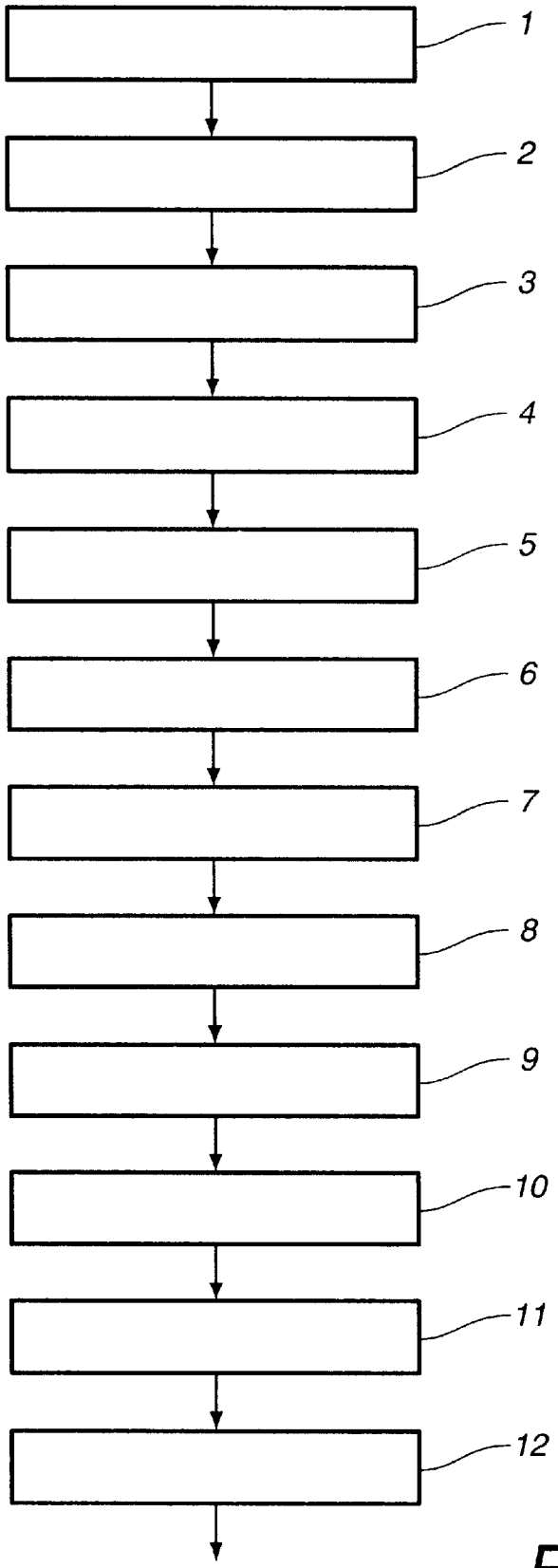
FIG. 1 shows a succession of operations according to the instant invention in a synoptic manner.

In FIG. 1, we apply the method the subject of this invention to a particular example: furniture wood. This furniture wood can be of M.D.F. (medium density fiber); in other words, a wood made in part from citrus fruit trees compressed under high pressure. This wood can also be a fiberboard and, more generally, any type of natural or recomposed wood used in furniture making. The part to be painted, as one can see particularly in FIG. 2, can be in the form of a polygon-shaped board, for example rectangular or square.

In FIG. 1 we have: the cut-out and formation (1), the drilling (2), the sanding and protection (3) of the edges, the sanding (4) of the entire part, the attachment (5) of the electrode, the application (6) of electrical tension on the electrode, the application (7) of electrical tension on the paint, the spraying (8) of the paint, the heating at low flow (9), the heating at increased flow (10), the cutting (11) of the edges and the application (12) of a glaze.

The cut-out and formation (1) exists in the prior art. It could involve, for example, cutting the part in a rectangular shape, rounding its edges and finally shaping by means of cuts and grooves. This gives the part its definitive shape. The other operations address the surface of the part to be painted. The wood to be used should preferably have an hygrometry of 8% to 12%.

The drilling (2) involves creating an initial hole in the part to be painted (without splitting the wood) in order to insert the electrode. The drilling will create a recessed hole and, where the part to be painted is a board, it will be drilled such that its median axis of symmetry runs perpendicular to the two large faces of the board.

The drilling (2) for the electrodes shall be done either in an area that will later be further manufactured or an area that will be eliminated when the edges are cut. Preferably, the drilling for the electrode is then used, for example, for the hanging of a door hinge or some other hinge or mechanical element used in the assembly of the boards of a piece of furniture. Where the electrode is affixed directly to the part to be painted, no drilling is done. Drilling is likewise not done if the shape of the electrode allows for its insertion into the part to be painted without risk of splitting the latter.

The protection of the edges (3) of the board is a characteristic operation of the instant invention. The edges of the piece of wood are sanded, for example with a sand paper of 400 grain for the M.D.F. and of 220 grain for the fiberboard, then they are covered with a sealant such as a barium-based wood paste or a polyurethane-based varnish. This process involves, therefore, sealing the pores of the wood, or filling in the uneven surfaces of the wood. This protection (3) of the edges also includes a drying period which may last several hours. This protection allows the pieces of wood to stand up to heating, even at high temperatures.

The sanding (4) is also one of the characteristic operations of the instant invention. The sanding is an action of preparing the surface prior to applying a product The sanding eliminates fibers, impurities, grease and grooves from the surface. This sanding is done according to the method of the instant invention with a sand paper of at least 300 grain, and, preferably of 400 grain This grain corresponds to a particular sanding operation called "egrenage" because of the fineness of the grain used. This sanding is done on all surfaces to be painted. The fineness of the grain allows for the fibers of the wood not to be opened to such an extent that, when heated in heating operations 9 and 10, there is any bubbling or significant evaporation. Thus, the state of the surface of the paint is not altered. When using a board, all sides are sanded.

The attachment of the electrode (5) involves mechanically fixing, and thus electrically fixing, the electrode to the part to be painted. According to the preferred embodiment, the electrode is inserted, preferably by force, into the hole created by drilling (2). This insertion can be done, for example, by driving or screwing. The electrode contains rigid or curved protrusions or acute angles. The electrode, therefore, contains certain concave parts. This operation is the principle characteristic of the invention because the shape of the electrode favors the development of either a spherical or a flat electrical field around the electrode once it is joined with a power source.

The application (6) of electrical tension on the electrode involves electrically joining the electrode with a source of electrical power. Generally, it is preferred that the tension be zero. Preferably, the electrode is joined to said power source by an electrical cable or metallic support The application of electrical tension on the paint (7) is done by a method known in the prior art. It involves electrically charging powdered paint, such as a polyester powder, with an opposite charge from that which charges the part to be painted, said electrical tension being delivered by the source of power to which the electrode is attached.

In this way, the equipotential lines are distributed throughout the part to be painted and one of them is practically identical to the volume of the part to be painted. It is notable that said effect applies to the part to be painted and, thus, the corners are painted in the same way as the rest of the part, if not better.

The spraying of the paint (8) is known in the prior art and is generally done using an electrostatic paint gun. It is the force of the spray, the static electricity and the electrical field created between the electrode and the gun that cause the movement of the powdered paint towards the part to be painted. Said electrostatic paint gun is connected to the source of power and is configured such that it electrically charges the paint whether the polarity is positive or negative.

The spraying of the paint is caused by sweeping, but the sprayed powdered paint coats with only one layer.

The heating at low flow (9) is done initially in a heating chamber into which the painted parts are introduced. The flow of hot air, which comes from the bottom of the chamber is checked by a mechanical protection Thus, the thermal shock is limited, as is the mixture of air which could disturb the uniformity of the distribution of the paint. This heating is limited to a very short time, approximately two to four minutes, during which the paint begins to adhere to the support.

The process of heating at increased flow (10) exists in the prior art. It takes place in the rest of the chamber. The two types of heating are done, for example, in a gas oven but it goes without saying that any type of heating chamber adapted for this function could be used. Finally, in the case of parts sold in panels, the cutting (11) of the edges allows for the pieces to meet the required dimensions and for the elimination of the drilled hole (2) created for the electrode.

The application (12) of varnish exists in the prior art, and is done, for example, by blower, by roller, by automatic or manual spray gun.

It is obvious from the description of FIG. 1 that the characteristic stages of the method are in order of decreasing importance.

- the use of an electrode which contains rigid or curved protrusions or acute angles and which, thus, favors the development of either a spherical or a flat electrical field around the electrode once it is joined to a power source.
- the sanding done with a sand paper of at least 300 grain, and, preferably of 400 grain, corresponding also to a method called "egrenage". This sanding lessens the roughness of the surface without making buckling possible at the time of heating.
- the protection of the edges (3) which are covered with a wood paste which may be diluted or with a polyurethane varnish This process, therefore, involves sealing the pores of the wood, or filing in the uneven surfaces of the wood. This protection of the edges also includes a drying period which may last several hours.

In FIG. 1, the method the subject of this invention is applied to a particular example, that of furniture wood. However, other examples could be used such as plaster, compost, brick, polyvinyl chloride, tile and, more generally, any materially that is a poor conductor.

This method according to the instant invention could also be applied to cardboard products made from shredded materials mixed with a urea-based glue and heat compressed. The shredded materials could be folded boxes lined with a sheet of aluminum.

It is important to note that the paint can be metallic and/or cause the plating of the part to be painted or some other effect such as a granular, a hammered, a shaped or a smooth appearance.

The products made according to the method described by FIG. 1 have successfully withstood resistance tests with shocks of ball bearings of up to 110 grams, tests for qualifications of lacquer paints and varnishes, adhesion trials by section on varnish or lacquer, resistance tests using scratching, cigarette burns, stains with domestic products and food products.

According to one variation, the method includes a varnish stage using clear vanish which dries to display ultraviolet radiation with a brilliance of 25% to 100%, according to the selection of the user, without requiring additional sanding. The grams per meter squared reach between 90 and 160 ideally with a precision and homogeneity of 10 grams.

According to a second variation, the method includes a varnish stage where a polyurethane varnish of traditional drying or a diluted wood paste of traditional drying is applied.

According to these two variations, the application could be done, for example, by robot, by blower, by spray gun or manually.

Figure 2:
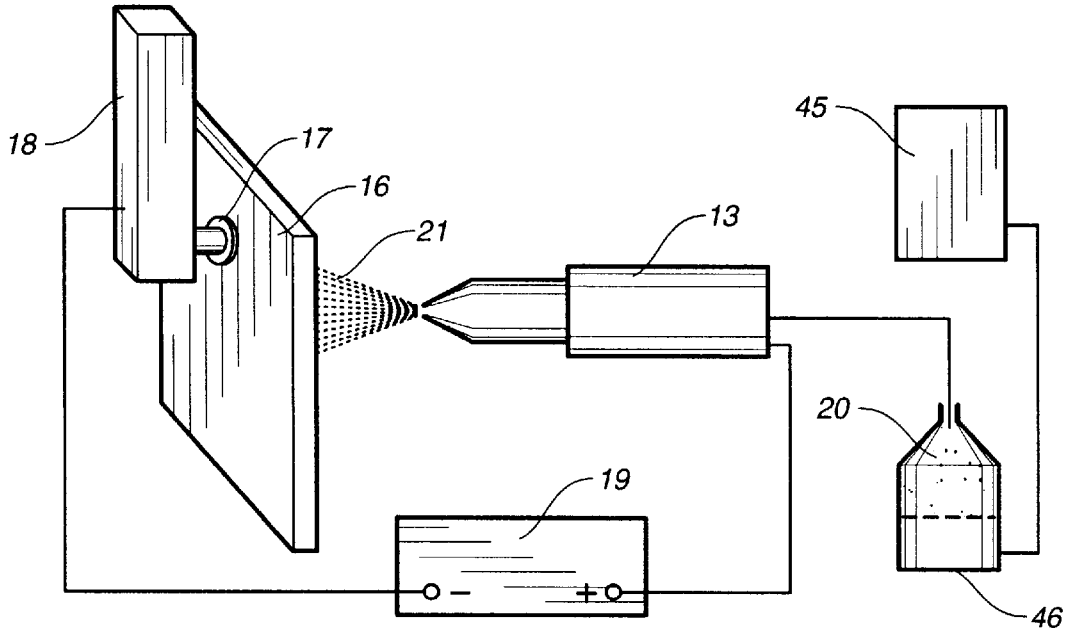
FIG. 2 is a schematic view of a painting apparatus with electrode according to the invention and it is intended as a model for operation according to the invention.

FIG. 2 is a schematic representation of a painting apparatus according to the invention.

FIG. 2 represents a paint spraying unit (13), a part to be painted (16), an electrode (17), a support for the electrode (18) and a power source (19), the paint (20), a stream of paint (21), a compressor (45) and a tank for powder (46) constituting a paint (20) supply.

The paint spraying unit (13) is configured so as to direct the stream of electrically-charged paint (21) towards the part (16) to be painted. It is of a type known in the prior art. This paint spraying unit contains an internal chamber housed within a projection gun and connected both to a paint outlet at one end and to a paint supply (46) by way of a conduit. The paint, in powdered form, is fed, using compressed air through the chamber from the paint supply (46) to the outlet. Within the chamber in the paint spraying unit is an electrode, not shown, which is electrically connected by the electric cascade of the paint spraying unit to the positive pole of the electric power source (19). The other pole of the power source (19) is electrically connected to the electrode (17) either directly or indirectly by way of the support (18). Between the electrode (17) and the electrode of the paint spraying unit, therefore, an electrostatic field is created which can be negatively or positively charged according to the selection of the electric cascade. The paint becomes electrically charged as it passes through the chamber and comes in proximity to or in contact with the electrode of the paint spraying unit. Preferably, the electric power source provides between its terminals a potential difference of several tens of kilovolts.

Step 8 of FIG. 1, involves the spraying of the paint onto the part to be painted. The part has, therefore, already been sanded with a sand paper of at least 300 grain and the roughness of its edges has been plugged.

The compressor (45) injects the compressed air into the powder supply (46) according to techniques existent in the prior art in order to convert the powder into aerosol The aerosol then passes into the paint spraying unit.

The support (18) for the electrode is configured so as to mechanically support the electrode (17) and the part to be painted (16) and so as to electrically connect one of the electrical terminals of the power source (19) to the electrode (17). The electrode (17) favors the development of either a spherical or a flat electrical field around itself once it is joined to the power source. The electrode (17) is conductive and contains jagged portions, such as for instance, rigid or curved protrusions or acute angles. Thus the electrode (17) contains certain concave parts. It is connected electrically to an electrical mass and to the part to be painted (16). The negative pole of the power source (19) will be connected to said electrical mass. It also serves as a support for the part to be painted (16).

Each protrusion which is a part of the electrode (on its surface, according to a normal plan) could have an acute triangular or trapezoidal section or any such form presenting a region of strong curvature at a distance from said surface.

Each protrusion could be in the form of a spike and project at a right angle from the surface of the electrode or could be curved, for example circular, helix-shaped or curved in some other manner.

The electrode could contain a core with the protrusion(s) being located on the exterior surface of the core and being spread out radially about said surface. Such an electrode with core is intended to be inserted into the hole previously made in the part to be painted.

Such an electrode, once it is connected mechanically and electrically to a part, i.e. a polygonal board, of which all of the exterior surfaces are to be painted, is inserted into the board preferably in the direction of the width of the board. The longitudinal axis of the core of the electrode is, therefore, perpendicular to the two large faces of the board.

The core could be in the shape of a long, rectangular figure, but preferably the core would be cylindrical or conical The protrusions of an electrode with cylindrical or conical core could each form, according to one of the generators of the exterior cylindrical or conical surface of the core, or also, they could form in a curved manner on said exterior surface, for example, in helix-shape, in circle or otherwise. The protrusions of an electrode with cylindrical or conical core could also be composed of spikes forming radially with respect to the core.

Figure 3:
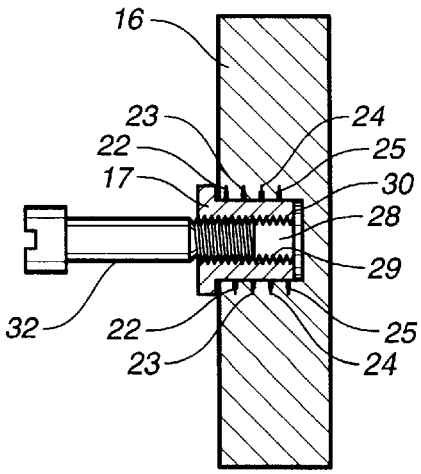
FIG. 3 is a cross-section view of one embodiment of the electrode according to the instant invention.
Figure 4:
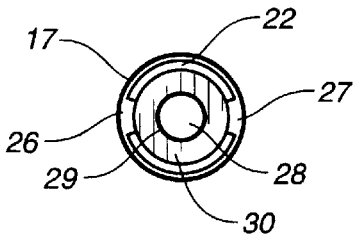
FIG. 4 is a front-view of the electrode according to FIG. 3.

FIG. 3 is a cross-section view of a preferred embodiment of the electrode the subject of this invention. FIG. 4 is a front-view of the same embodiment of the electrode. Said electrode, with cylindrical core, has external threading and at least one longitudinal groove extending along the generator of the core and through threading of the screw.

FIG. 3 and FIG. 4 show a part to be painted (16), an electrode (17) with a cylindrical core, external threading (22, 23, 24, 25), at least one groove, an internal cavity (28), internal threading (29), a front end (30) and a rod (32). Preferably, the electrode will have two grooves (26, 27) which are diametrically opposed. The electrode could be equipped with a greater number of grooves which would be spaced equidistant from one another. Note: the length of the electrode depends upon the width of the part to be painted.

The part to be painted (16) is pierced by a hole of a diameter roughly equal to the diameter of the base of the electrode accounting for the string of external threadings (22, 23, 24 and 25) and its depth is roughly equal to or superior to the length of the portion of the electrode to be inserted into the board.

The external threadings (22, 23, 24 and 25) and the two grooves (26 and 27) are formed according to a unique pattern whereby the distance between two consecutive points of intersection of the circular helix is approximately 1 mm. Each piece of threading (22, 23, 24 and 25) is, therefore, roughly of the same length as the others, but shorter than one half the distance between two consecutive points of intersection of the circular helix created by grooves 26 and 27. The electrode (17) contains, therefore, curved and helicoidal protrusions and acute angles.

The cylindrical internal cavity (28) crosses the electrode along the longitudinal median axis of the core of the latter.

The electrode, as it is represented in FIG. 3, does not contain a shouldering, but it could be outfitted with one to limit the electrode's penetration into the part to be painted (16).

The internal threading (29), or screw cutting, extends the entire length of the internal cavity (28).

The metallic rod (32) allows for the insertion of the electrode (17) into the part to be painted (16) due to its shape and the connection of electrical connectors to the electrode (17). Preferably, the rod (32) is cylindrical and has a jagged threading at one end for screwing that extremity into the internal threading (29) of the electrode (17). Said rod (32) ensures an electrical and mechanical connection between the electrode and the support for the electrode (18). Said rod can also serve as a support for the electrode.

The electrode (17) according to FIGS. 3 and 4 is preferably inserted by screwing. Due to the presence of the grooves, the electrode according to such an embodiment is self-screwing and its screwing into the hole causes the screwing of the latter. Thus, the thread-shaped protrusions of this electrode penetrate completely the material of the board and are in direct contact with the part to be painted which improves both the electrical and mechanical connections of the board.

Preferably, the depth of insertion of the electrode (17) into the hole drilled in the part to be painted (16) is roughly greater than one-half the width of the part to be painted and roughly less than said width.

Figure 5:
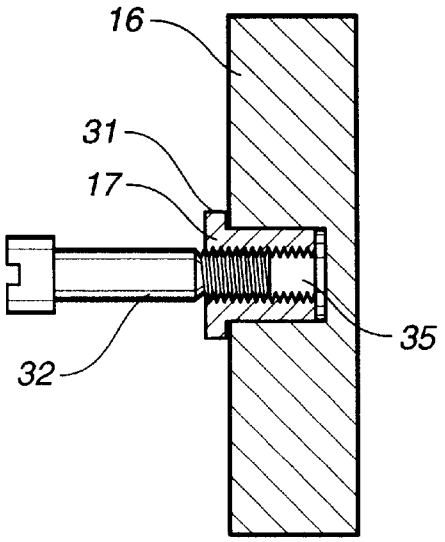
FIG. 5 is a cross-section view of a second embodiment of the electrode according to the instant invention.

FIG. 5 is a cross-section view of a second embodiment of the electrode the subject of this invention.

Figure 6:
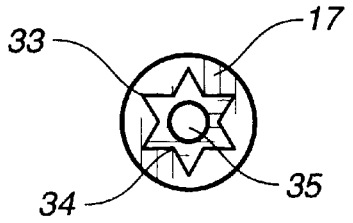
FIG. 6 is a front-view according to FIG. 5.

FIG. 6 is a front-view of the electrode shown in FIG. 5.

FIGS. 5 and 6 show a part to be painted (16), an electrode (17) with a core having straight, longitudinal external protrusions along its surface (33) separated by longitudinal crevices (34), an internal cavity (35), a shouldering (31) and a rod (32). This electrode contains a cylindrical core.

The straight, longitudinal external protrusions (33) and the crevices (34) form a polygonal-based prism, for example in the shape of a star. The internal cavity (35) crosses the electrode and extends along the longitudinal axis of the core of the latter. The shouldering (31) and the rod (32) which is cut jaggedly along one extremity have the same characteristics and functions as in FIGS. 3 and 4.

Preferably, the electrode (17) shown in FIGS. 5 and 6 is forcibly inserted into a pre-made hole in the board. The electrode (17), therefore, contains straight protrusions and acute angles.

Other embodiments of the electrode could conform to the spirit of the invention, such as wood screws, threaded rods, and the like.

Figure 8:
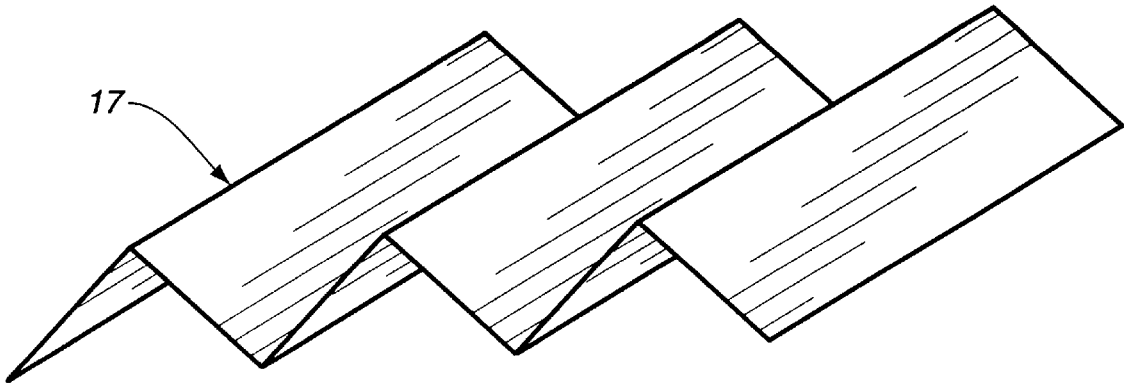
FIG. 8 is another embodiment of an electrode according to the instant invention.

As shown in FIG. 8, one could also envision an electrode in the form of a thin, polygon-shaped plate with its external protrusions being located along at least one of the faces of the plate. Such an electrode could be forcibly inserted into the wooden board without any drilling of the latter, or could be inserted into an opening created by drilling or could be attached to one of the faces of the board. The protrusions of said thin, plate-like electrode could be spike-like studs or the like. The protrusions will always contain a straight triangular or trapezoidal section or a section of some shape to serve as the location of peak electrostatic effect.

The plate could contain a series of protrusions and crevices such that it would be rippled. The ripples of the plate could be triangular. The broad faces of the ripples could be smooth or could have their own protrusions such as those already described.

Figure 7:
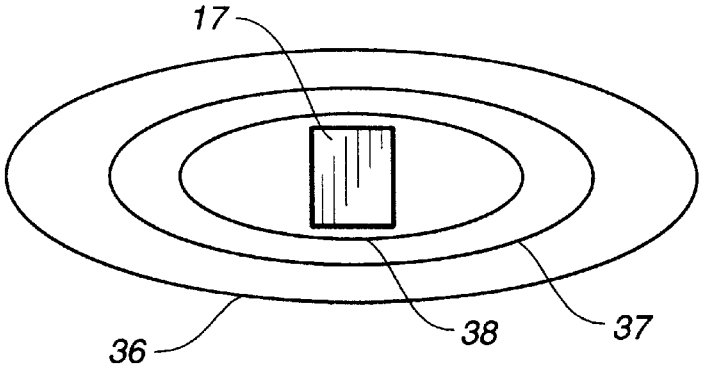
FIG. 7 is a cross-section view of an electrical field generation by an electrode according to the instant invention.

FIG. 7 is a cross-section view of an electrical field generated by an apparatus according to the instant invention.

FIG. 7 shows the equipotential lines (36, 37 and 38) generated when the inserted portion of the electrode (17) is placed under tension.

These equipotential lines (36, 37 and 38) are elliptical and, in space, their surface is ellipsoidal.

It is apparent that once the electrode (17) is inserted into the part to be painted (16), the lines of the field will take on a flattened form, and that one of them will be roughly identical in form to the part to be painted (16). This is due to the dielectricity of the material of the part to be painted (16) or to its poor conductivity.

Figure 9:
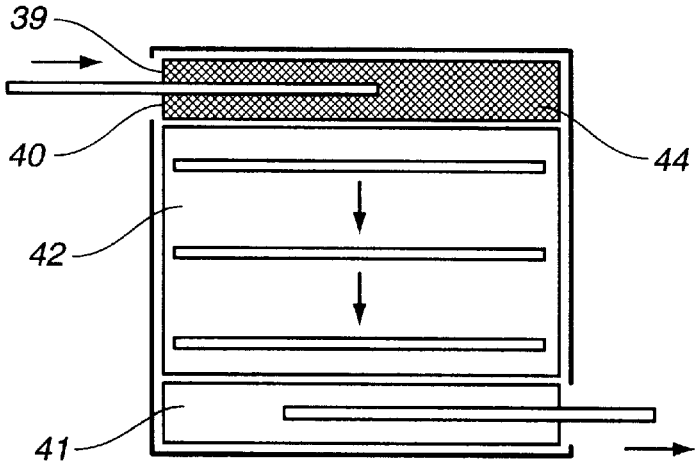
FIG. 9, shown from above and schematically, is a heating chamber of the painting apparatus according to the instant invention.

FIG. 9 is a paint heating chamber according to the instant invention.

FIG. 9 shows a heating chamber (39), a zone of entry for the parts (40), an outlet zone for the parts (41), an area of heating at increased flow (42) and a path for the hot air (43) equipped with a protection (44).

The heating chamber (39) contains a zone of entry for the parts (40) which is, for example, at one end of the heating chamber while the outlet zone for the parts (41) is at the other end. Between these two zones, an intermediate zone (42) extends. In this heating chamber (39), the first phase of heating or cooking involves lower speeds of air flow than do the subsequent phases of heating or cooking in order that the paint can gel before the part enters the zone of strong air flow. The first phase of heating occurs in the zone where the air enters, whereas the next phase occurs in the rest of the chamber, in zones 42 and 41. It is important to note that the entire volume of the heating chamber is at the same temperature.

The zone of heating at increased flow (42) includes both zones 42 and 41. According to the preferred embodiment, the heating chamber is equipped all over with openings for air to enter; the entrance of the air taking place at the bottom and the openings being throughout zones 40, 41 and 42. In order that the flow of air be slowed in the zone of entry, said zone is equipped with a screen made up of an immobile partition placed at the base of zone 40 to cover the openings for air to enter said zone. According to this method and apparatus for heating, the parts to be painted (16) are subjected first to heating without thermal shock or mixing of air as these two events could cause the deterioration of the paint on the surface of the parts (16) given that the paint is still in solid powder form on the surface of the parts (16).

It is important to note that the temperatures and heating times to be used are those that are recommended for the powdered paint to be used because the wood, once its edges have been treated and its rigid plugged, can withstand quite high temperatures without thermal dilatation.

The method and apparatus described in the instant invention can be used for painting fiberboard, compressed wood, fiberboard coated with a polyvinyl film such as polished polyvinyl chloride or an imitation oil, wood of medium density fiber whether coarse or smooth or coated with polyvinyl chloride or an imitation oil or a natural veneer.

It is important to note that the electrode can be a part of the finished product and, therefore, would not have to be removed from the board. Said electrode in this case could eventually serve as a brace for the board.

I claim:

1. A method for painting a part of a dielectric material with paint in powder form using a paint spraying unit, the paint spraying unit having a chamber connected both to a paint outlet and to a paint supply, an electrode is housed in the chamber and is electrically connected to a first pole of a power source, the method comprising:

forming another electrode having a cylindrical or tapered core, said another electrode having angular protrusions on an external surface of said core;

inserting and connecting said angular protrusions of said another electrode mechanically and electrically in a thickness of the part;

connecting said another electrode electrically to a second pole of the power source;

creating an electrostatic field between said another electrode and the paint spraying unit by applying a potential difference between said another electrode and the electrode housed in the chamber of the paint spraying unit;

feeding the paint in powder form from the paint supply towards the paint outlet by passage through the chamber of the paint-spraying unit;

electrically charging the paint with said electrode during the passage through the chamber; and directing the paint towards at least one surface of the part.

2. The method of claim 1, the step of connecting comprising the step of:

placing said another electrode on at least one external face of the part.

3. The method of claim 2, further comprising the step of:

sanding said surface of the part prior to the step of directing the paint.

4. The method of claim 3, said at least one surface of the part having grooves along edges thereof, the method further comprising the step of:

applying a sealant to the grooves prior to the step of directing the paint.

5. A system for electrostatically painting with paint in powder form, the system comprising:

a part made of a dielectric material;

an electric power source having two poles;

a paint spraying unit having a central chamber with a first electrode therein, said first electrode being connected to a first pole of said two poles of said power source,; and a second electrode connected to a second pole of said two poles of said electric power source, said second electrode having a cylindrical or tapered core, said second electrode having angular protrusions formed on an external surface of said core, said angular protrusions engaged with the part.

6. The system of claim 5, each of said protrusions being longiform and projecting rectilinearly.

7. The system of claim 5, said protrusions forming a helix shape in said external surface of said core.

8. The system of claim 5, said core having external threading with a longitudinal groove extending along said core across said external threading.

9. The system of claim 5, said second electrode having a form of a plate, said protrusions located on at least one face of said form.

10. The system of claim 5, said second electrode being a rippled form.

11. The system of claim 10, each ripple of said rippled form of said second electrode being of a generally triangular configuration.

* * * * *